US009657735B2

(12) United States Patent
Matsui et al.

(10) Patent No.: US 9,657,735 B2
(45) Date of Patent: May 23, 2017

(54) SCREW FLUID MACHINE, INCLUDING MALE AND FEMALE ROTORS

(71) Applicant: MAYEKAWA MFG. CO., LTD., Tokyo (JP)

(72) Inventors: Akira Matsui, Tokyo (JP); Hironori Yamashita, Tokyo (JP)

(73) Assignee: MAYEKAWA MFG. CO., LTD., Tokyo (JP)

( * ) Notice: Subject to any disclaimer, the term of this patent is extended or adjusted under 35 U.S.C. 154(b) by 0 days.

(21) Appl. No.: 14/428,499

(22) PCT Filed: Sep. 17, 2013

(86) PCT No.: PCT/JP2013/075003
§ 371 (c)(1),
(2) Date: Mar. 16, 2015

(87) PCT Pub. No.: WO2014/050632
PCT Pub. Date: Apr. 3, 2014

(65) Prior Publication Data

US 2015/0211517 A1 Jul. 30, 2015

(30) Foreign Application Priority Data

Sep. 26, 2012 (JP) ..... 2012-212086

(51) Int. Cl.
*F04C 18/00* (2006.01)
*F04C 18/16* (2006.01)
(Continued)

(52) U.S. Cl.
CPC ..... *F04C 18/18* (2013.01); *F04C 18/084* (2013.01); *F04C 18/16* (2013.01); *F04C 18/20* (2013.01)

(58) Field of Classification Search
CPC ..... F04C 18/084; F04C 18/16; F04C 18/18; F04C 18/20; F04C 29/00; F04C 15/0026; F04C 15/06
(Continued)

(56) References Cited

U.S. PATENT DOCUMENTS 4,412,796 A * 11/1983 Bowman ..... F01C 1/084 418/201.3
4,576,558 A * 3/1986 Tanaka ..... F04C 18/16 418/150
(Continued)

FOREIGN PATENT DOCUMENTS

CN 1434214 A 8/2003
CN 102352846 A 2/2012
(Continued)

OTHER PUBLICATIONS

International Preliminary Report on Patentability issued in PCT/JP2013/075003, mailed Apr. 9, 2015.
(Continued)

*Primary Examiner* — Nicholas J Weiss
*Assistant Examiner* — Dapinder Singh
(74) *Attorney, Agent, or Firm* — Rossi, Kimms & McDowell LLP

(57) ABSTRACT

The objective of the present invention is to reduce a meshing seal line length and further reduce a blowhole area. A compression side blowhole $B_2$ is generated in a region surrounded by a male rotor side blowhole contour $R_1$, a female rotor side blowhole contour $R_2$, and a lower cusp line $k_2$. By configuring a female rotor side blowhole contour $R_3$ with a curve including at least two arcs $C_1$ and $C_2$, an area of the compression side blowhole $B_2$ may be reduced. At a connection point between arcs, by making tangents of the
(Continued)

arcs on both sides across the connection point to be the same gradient, the arcs may be smoothly connected.

6 Claims, 4 Drawing Sheets

(51) Int. Cl.
*F04C 29/00* (2006.01)
*F04C 18/18* (2006.01)
*F04C 18/08* (2006.01)
*F04C 18/20* (2006.01)

(58) Field of Classification Search
USPC ..... 418/3, 9, 15, 191, 201.1, 205, 206.1, 418/206.6, 201.3
See application file for complete search history.

(56) References Cited

U.S. PATENT DOCUMENTS 4,643,654 A * 2/1987 Rinder ..... B23F 15/08 418/150
5,454,701 A * 10/1995 Chen ..... F04C 18/084 418/201.3
5,460,495 A 10/1995 Matsui et al.
5,624,250 A * 4/1997 Son ..... F04C 18/084 418/150
6,296,461 B1 * 10/2001 Stosic ..... F04C 18/084 29/888.023
6,779,993 B2 * 8/2004 Kim ..... F04C 18/16 418/201.3
8,246,333 B2 * 8/2012 Ju ..... F04C 18/20 418/201.3
2003/0170135 A1 9/2003 Kim et al.

FOREIGN PATENT DOCUMENTS

JP 4516872 B2 6/1970
JP 06123294 A 5/1994
JP 3356468 B2 12/2002
JP 2011027028 A 2/2011
WO 2010133981 A1 11/2010

OTHER PUBLICATIONS

Written Opinion issued in PCT/JP2013/075003, mailed Dec. 17, 2013. English translation provided.
International Search Report issued in PCT/JP2013/075003, dated Dec. 17, 2013. English translation provided.
Office Action issued in Chinese Appln. No. 201380050267.5 mailed Apr. 1, 2016.

* cited by examiner

Fig.4
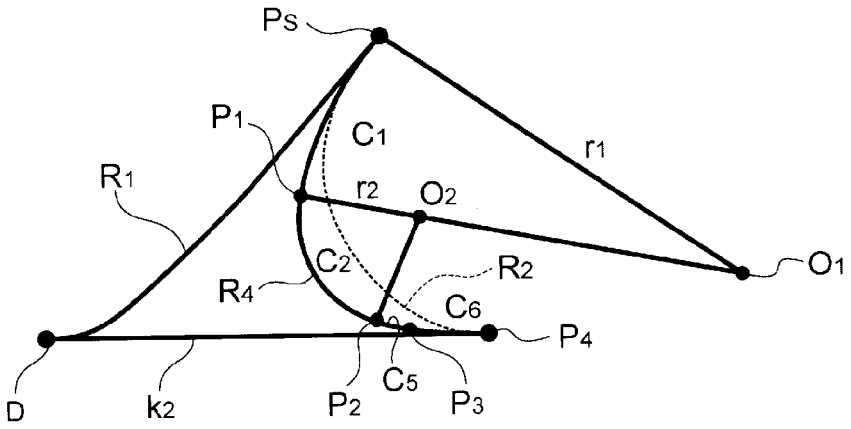
Fig.5
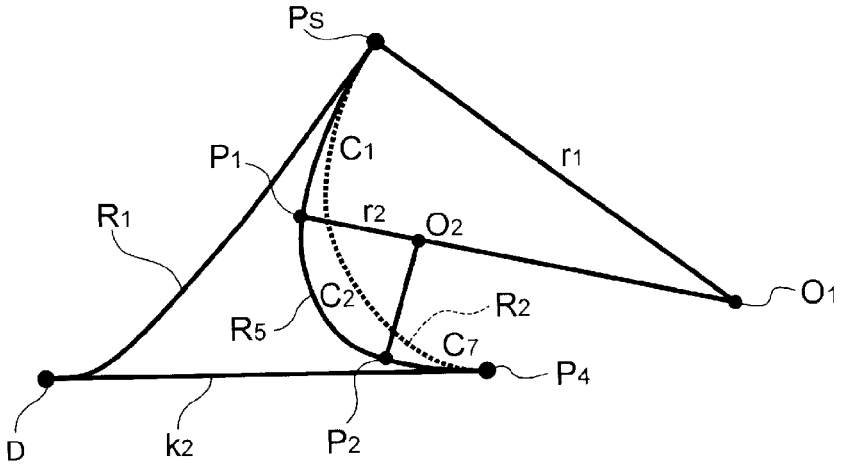
Fig.6
Table 1
| | |
|---|---|
| The number of teeth of male rotor | 4 |
| The number of teeth of female rotor | 6 |
| Distance between centers of rotors | 110mm |
| Outer diameter of male rotor | 140.3mm |
| Outer diameter of female rotor | 140.3mm |
| Lead length of male rotor | 278.0mm |
| Lead length of female rotor | 417.0mm |

Fig.7
Table 2
| Type of blow hole contour | Blow hole area [mm²] | Engagement seal line length [mm] |
|---|---|---|
| Conventional type (conventional technology) | 26.9 | 175.7 |
| Four arcs | 20.4 | 175.6 |
| Two arcs + two parabolas | 20.4 | 175.5 |
| Two arcs + cubic curve | 20.4 | 175.5 |
Fig.8
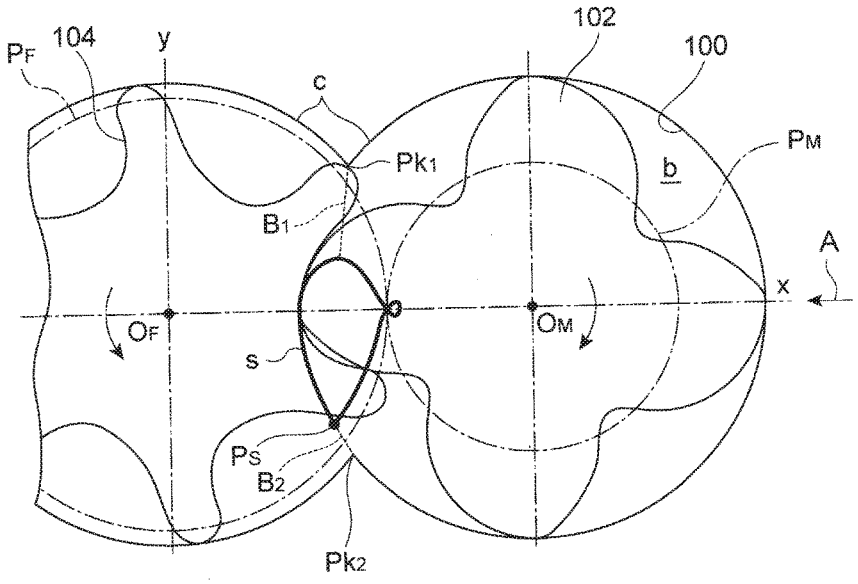
Fig.9
(Prior Art)
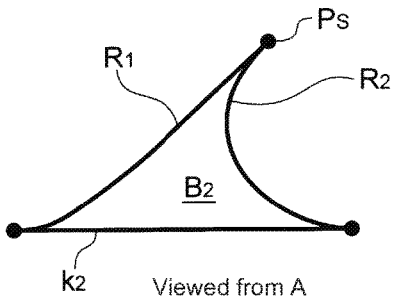

SCREW FLUID MACHINE, INCLUDING MALE AND FEMALE ROTORS

TECHNICAL FIELD

The present invention relates to a screw type fluid machine equipped with a screw rotor, such as a compressor, an air blower, and an expander.

BACKGROUND

In a screw compressor and such that compress a gas by making a pair of male and female rotors to be engaged with each other, a typical cause of performance degradation is an internal leakage. The internal leakage is a phenomenon in which a compressed gas flows backwards from a compression chamber formed between the male and female rotors to a compression chamber of lower pressure. Since suction of the gas is inhibited by the internal leakage and power loss occurs by recompression of a leakage gas, performance of the screw compressor and such is degraded. In the screw compressor and such, a series of continuous contact points are formed between the male and female rotors. The series of continuous contact points is called a meshing seal line. The meshing seal line has a function of sealing the compressed gas. A length of the meshing seal line is preferred to be short from a view point of reducing the internal leakage of the gas. Trials for suppressing the gas leakage from the meshing seal line are made by shortening the length of the meshing seal line formed between the male and female rotors as much as possible as a measure against the internal leakage.

As a second problem, there is a problem of a "blowhole". In a screw rotor in which a female rotor has an addendum outside of a pitch circle and a male rotor has a dedendum inside a pitch circle, a blowhole is formed. The blowhole is formed among male and female rotors and a cusp line where bores formed in a casing are crossed. Through the blowhole, a gas leakage occurs. Formation of the blowhole is described with reference to FIG. 8. FIG. 8 is a view illustrating a cross-section perpendicular to an axis. In a casing bore b formed inside a casing 100 of the screw compressor, a male rotor 102 and a female rotor 104 are provided. The male rotor 102 and the female rotor 104 rotate in directions of arrows about a center-of-rotation $O_M$ and about a center-of-rotation $O_F$, respectively. In the figure, $P_M$ represents a pitch circle of the male rotor 102, and $P_F$ represents a pitch circle of the female rotor 104.

An internal wall of the casing bore b also has a gas sealing function of the compression chamber by being in contact with the male and female rotors. Hereinafter, a line of intersection between the internal wall of the casing bore b and the cross-section perpendicular to the axis is called a tip seal line c. A meshing seal line s formed between the male rotor 102 and the female rotor 104, and the tip seal line c formed at a rotor outer peripheral part are not connected and are discontinuous. The discontinuous part is called a blowhole, and is literally an open ceiling section. The blowholes are formed at two positions that are a suction side blowhole $B_1$ and a compression side blowhole $B_2$. The suction side blowhole $B_1$ is formed between an upper cusp point $Pk_1$ and the meshing seal line s. The compression side blowhole $B_2$ is formed between a blowhole side closest point $P_s$ of the meshing seal line s and a lower cusp point $Pk_2$.

It is the compression side blowhole $B_2$ which causes a problem from a viewpoint of performance of the screw compressor.

FIG. 9 illustrates a shape of the compression side blowhole $B_2$. The compression side $B_2$ is formed among the lower cusp line $k_2$, a male rotor side blowhole contour $R_1$ formed by a line of intersection between a tooth face of the male rotor 102 and a blowhole plane including the blowhole side closest point $P_s$ and the lower cusp line $k_2$, and a female rotor side blowhole contour $R_2$ formed by a line of intersection between a tooth face of the female rotor 104 and the blowhole plane. Normally, an area of a cut end cut by the blowhole plane is a representative area of the compression side blowhole $B_2$. This is applied also to the present description. FIG. 9 is a drawing viewed from a direction indicated by an arrow A, and is a drawing in which the blowhole plane is projected onto a plane including a y-axis in FIG. 8. FIG. 10 is a view illustrating a shape of the meshing seal line s viewed in the direction indicated by the arrow A. In the figure, ΔLs represents part of the meshing seal line s corresponding to one tooth.

The applicant previously proposed a configuration of a screw rotor capable of reducing an area of the blowhole (Patent Document 1). The invention is to make a cross-section shape perpendicular to the axis from an addendum top center of the female rotor to a pitch circle on a side advancing against a rotation direction to be formed of three or more arcs, which reduces the blowhole area.

CITATION LIST

Patent Literature

Patent Document 1: Japanese Patent No. 3356468

SUMMARY

Technical Problem

However, in general, in a fluid machine equipped with the screw rotor, a length of the meshing seal line and an area of the blowhole are in a conflicting relation. In other words, when the meshing seal line is made shorter, the blowhole area increases. Therefore, it is difficult to simultaneously achieve reduction in the meshing seal line length and reduction in the blowhole area. Since the internal leakage suppressing means disclosed in Patent Document 1 mainly reduces the blowhole area, it is necessary to consider an internal leakage suppressing means including shortening of the meshing seal line length.

The present invention, in view of the problem in the prior art, aims at achieving reduction in the meshing seal line length and further reduction in the blowhole area.

Solution to Problem

The present invention is applied to a screw-type fluid machine including a screw rotor having a problem of formation of a blowhole and including a male rotor and a female rotor that are engaged with each other and mutually rotate, wherein the female rotor has an addendum outside a pitch circle, the male rotor has a dedendum inside a pitch circle. To achieve the objective, in a screw-type fluid machine of the present invention, among contours of a blowhole formed among the male and female rotors and a cusp line formed in a casing, a female rotor side blowhole contour formed by the female rotor between a blowhole side closest point of the meshing seal line and the cusp line is composed of a plurality of contour elements, wherein the plurality of contour elements include at least two arcs.

In the present invention, tooth profiles of the male and female rotors are configured under a condition where the meshing seal line formed between the male rotor and the female rotor becomes equal to or less than a setting value. For instance, the tooth profiles of the male and female rotors are so configured that the meshing seal line becomes as short as possible in design. A compression side blowhole is formed among the male and female rotors and a lower cusp line. In the present invention, among the compression side blowhole contours, the female rotor side blowhole contour formed by the female rotor between the blowhole side closest point of the meshing seal line and the cusp line is made to be composed of a contour including at least two arcs. By including at least two arcs in the female rotor side blowhole contour, the blowhole area may be reduced. A tooth profile of the female rotor is obtained by mathematically transforming the blowhole contour formed by the female rotor. A tooth profile of the male rotor is generated corresponding to the tooth profile of the female rotor. A shape generation theory requires that a center of curvature of the obtained female rotor tooth profile is located inside the pitch circle.

The blowhole area reducing means described in Patent Document 1 is to find out a female rotor tooth profile capable of reducing the blowhole area by trial and error. On the other hand, the present invention is to find out a female rotor side blowhole contour capable of reducing the blowhole area at first, and to determine a tooth profile of the female rotor according to the contour. Therefore, a tooth profile of the female rotor capable of reducing the blowhole area may be selected without trial and error. Since tooth profiles of the male and female rotors are selected so that the meshing seal line becomes as short as possible in design in advance, shortening of the meshing seal line length and reduction in the blowhole area may be simultaneously achieved.

In the present invention, specifically, the female rotor side blowhole contour may be composed of a first arc connected to the blowhole side closest point of the meshing seal line, a second arc connected to the first arc, and a contour element composed of a curve extending between a terminating end of the second arc and the cusp line. Thereby, a contour capable of reducing the blowhole area may be formed.

In the configuration, a curve connecting the terminating end of the second arc and the cusp line may be composed of a third arc connected to the terminating end of the second arc and a fourth arc extending between a terminating end of the third arc and the cusp line. In this way, by configuring the female rotor side blowhole contour by four different arcs, a contour capable of reducing the compression side blowhole area may be formed.

Alternatively, the curve extending between the terminating end of the second arc and the cusp line may be composed of a first parabola connected to the terminating end of the second arc and a second parabola connecting a terminating end of the first parabola and the cusp line. In this way also, a contour capable of reducing the compression side blowhole area may be formed.

Alternatively, the curve extending between the terminating end of the second arc and the cusp line may be composed of one cubic curve. In this way also, a contour capable of reducing the compression side blowhole area may be formed.

In the present invention, at a connection point between contour elements composed of an arc, a parabola, or a cubic curve, tangents of the contour elements on both sides across the connection point may have a same gradient. In this way, different curves may be smoothly connected while reducing the blowhole area.

Advantageous Effects

According to the present invention, shortening of the meshing seal line length and further reduction in the blowhole area may be simultaneously achieved, and an internal leakage of the screw-type fluid machine may be effectively suppressed.

BRIEF DESCRIPTION OF DRAWINGS

FIG. 4 is a diagram illustrating a shape of the compression side blowhole associated with the second embodiment of the present invention.

FIG. 5 is a diagram illustrating a shape of the compression side blowhole associated with the third embodiment of the present invention.

FIG. 6 is a chart (Table 1) illustrating specifications of a screw rotor provided for embodying the present invention.

FIG. 7 is a chart (Table 2) illustrating a result of embodying the present invention using the screw rotor having the specifications of FIG. 6 (Table 1).

FIG. 8 is an explanatory drawing illustrating a shape of a cross-section perpendicular to the axis of the screw rotor.

FIG. 9 is a diagram illustrating a blowhole shape of the conventional screw rotor.

DETAILED DESCRIPTION

Embodiments of the present invention will now be described in detail with reference to the accompanying drawings. It is intended, however, that unless particularly specified, dimensions, materials, shapes, relative positions and the like of components described in the embodiments shall be interpreted as illustrative only and not limitative of the scope of the present invention.

Embodiment 1

Figure 1:
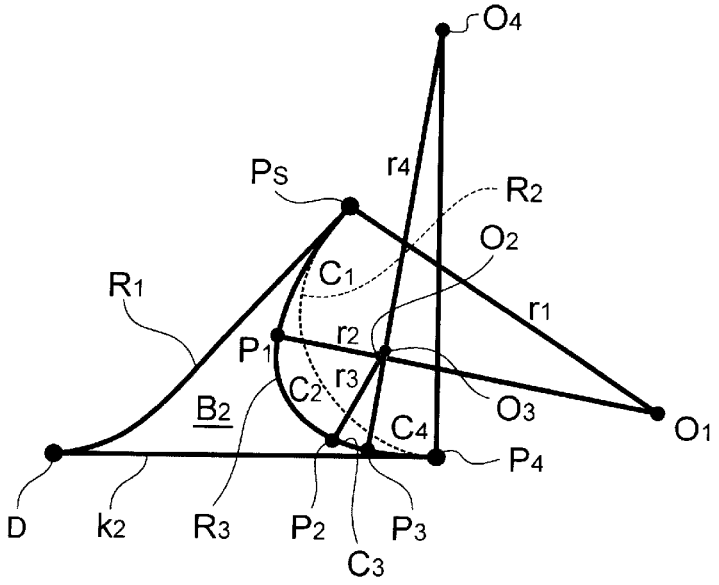
FIG. 1 is a diagram illustrating a shape of the compression side blowhole associated with the first embodiment of the present invention.
Figure 2:
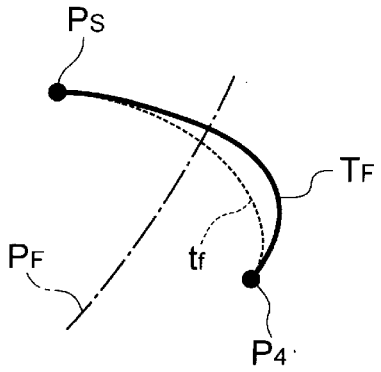
FIG. 2 is a diagram illustrating part of a tooth profile of the female rotor produced on the basis of the shape of the compression side blowhole in FIG. 1.
Figure 3:
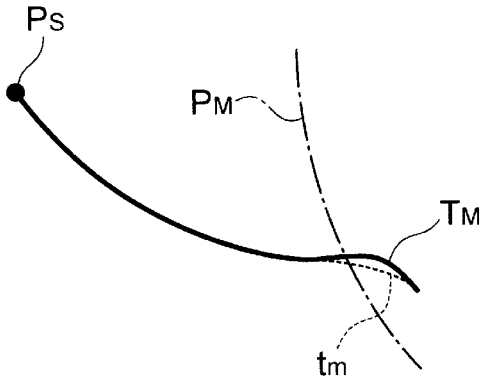
FIG. 3 is a diagram illustrating part of a tooth profile of the male rotor generated corresponding to the tooth profile of the female rotor in FIG. 2.
Figure 10:
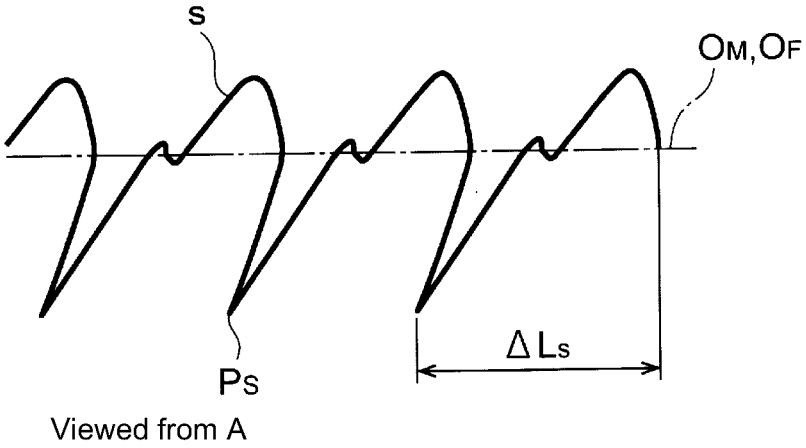
FIG. 10 is a diagram illustrating the meshing seal line of the screw rotor.

A first embodiment of the present invention is described on the basis of FIG. 1 to FIG. 3. The present embodiment is used for a screw compressor, and is an example that is applied to a screw rotor composed of a male rotor having 4 teeth and a female rotor having 6 teeth. In the present embodiment, at first, a length of the meshing seal line s formed between the male and female rotors is set at a length that is shortened as much as possible with respect to specifications of the screw compressor. An area of the compression side blowhole $B_2$ is set on the basis of the meshing seal line s set as described above.

FIG. 1 roughly illustrates a shape of the compression side blowhole $B_2$. The compression side blowhole $B_2$ is formed among a lower cusp line $k_2$, a male rotor side blowhole contour $R_1$ formed by the male rotor, and a female rotor side blowhole contour $R_3$ formed by the female rotor. The female rotor side blowhole contour $R_3$ is a blowhole contour set in the present embodiment. A female rotor side blowhole contour $R_2$ is a blowhole contour formed by a tooth profile of the female rotor proposed in Patent Document 1. In the figure, a point D is an intersection of the lower cusp line $k_2$ and the male rotor side blowhole contour $R_1$, and a point $P_4$ is an intersection of the lower cusp line $k_2$ and the female rotor side blowhole contour $R_2$ and $R_3$.

The female rotor side blowhole contour $R_3$ is formed by four arcs $C_1$ ($P_s$ to $P_1$), $C_2$ ($P_1$ to $P_2$), $C_3$ ($P_2$ to $P_3$), and $C_4$ ($P_3$ to $P_4$). A starting end of the arc $C_1$ is a blowhole side closest point $P_s$ of the meshing seal line s, and a starting end of the arc $C_2$ is connected to a terminating end of the arc $C_1$. A starting end of the arc $C_3$ is connected to a terminating end of the arc $C_2$, and a starting end of the arc $C_4$ is connected to a terminating end of the arc $C_3$. A terminating end of the arc $C_4$ is connected to the lower cusp line $k_2$ at the intersection $P_4$.

A center of the arc $C_1$ is $O_1$, and a curvature radius is $r_1$. A center of the arc $C_2$ is $O_2$, and a curvature radius is $r_2$. A center of the arc $C_3$ is $O_3$, and a curvature radius is $r_3$. A center of the arc $C_4$ is $O_4$, and a curvature radius is $r_4$. At a connection point of each arc, tangents of the arcs on both sides across the connection point have a same gradient, and the both tangents are overlapped. Thus, at the connection point of each arc, the arcs on both sides are smoothly connected. The curvature radius $r_1$ and $r_4$ are set at diameters significantly larger than the curvature radius $r_2$ and $r_3$. Thereby, formation of a blowhole contour capable of reducing the compression side blowhole $B_2$ becomes easy.

As illustrated in FIG. 1, it is apparently understood that the area of the compression side blowhole $B_2$ formed by the female rotor side blowhole contour $R_3$ of the present embodiment is decreased from the area of the compression side blowhole formed by the female rotor side blowhole contour $R_2$. Both ends of the female rotor side blowhole contours $R_2$ and $R_3$ coincide at the blowhole side closest point $P_s$ and the intersection $P_4$, and gradients of tangents of the both contours at the blowhole side closest point $P_s$ and the intersection $P_4$ are the same. This makes it possible to smoothly connect tooth profiles at the blowhole side closest point $P_s$ and the intersection $P_4$, while minimizing both the seal line length and the blowhole area. By making tooth profiles smooth at these points, it is possible to eliminate stress concentration and a meshing failure of the male rotor, and prevent fatigue breakdown such as pitting occurring at tooth faces.

A tooth profile of the female rotor is obtained by mathematically transforming the female rotor side blowhole contour $R_3$. A tooth profile of the male rotor is generated corresponding to the tooth profile of the female rotor. Part of the tooth profile of the female rotor at the cross-section perpendicular to the axis thus obtained is illustrated in FIG. 2, and part of the tooth profile of the male rotor is illustrated in FIG. 3. In FIG. 2, a curve $T_F$ is part of the tooth profile of the female rotor of the present embodiment, and a curve $t_f$ is part of the tooth profile of the female rotor proposed by Patent Document 1. In FIG. 3, a curve $T_M$ is part of the tooth profile of the male rotor of the present embodiment, and a curve $t_m$ is part of the tooth profile of the male rotor proposed by Patent Document 1.

In FIG. 2, the curve $T_F$ is protruded more toward the male rotor side than the curve $t_f$, and in FIG. 3, the curve $T_M$ is recessed toward a direction more away from the female rotor than the curve $t_m$. When the obtained female rotor tooth profile includes an arc, it becomes required on the basis of a shape generation theory that a center of curvature of the arc is to be inside the pitch circle.

According to the present embodiment, a female rotor side blowhole contour $R_3$ capable of reducing an area of the compression side blowhole $B_2$ is to be found first, and then a tooth profile of the female rotor is determined according to the female rotor side blowhole contour $R_3$. Therefore, a tooth profile of the female rotor capable of reducing compression side blowhole area $B_2$ may be selected without trial and error, and an area of the compression side blowhole $B_2$ may be further reduced than Patent Document 1. Since a curvature radius $r_1$ of the arc $C_1$ connected to the blowhole side closest point $P_s$ of the meshing seal line s and a curvature radius $r_4$ of the arc $C_4$ connected to the intersection $P_4$ are set at diameters significantly larger than the curvature radiuses $r_2$ and $r_3$ of the other arcs, formation of the female rotor side blowhole contour that reduces the area of the compression side blowhole $B_2$ becomes easy.

Embodiment 2

A second embodiment of the present invention is described with reference to FIG. 4. The present embodiment is also an example that is applied to a screw compressor of the same specifications as the first embodiment. In FIG. 4, the female rotor side blowhole contour $R_4$ of the present embodiment is composed of two arcs $C_1$ ($P_s$ to $P_1$) and $C_2$ ($P_1$ to $P_2$), and two parabolas $C_5$ ($P_2$ to $P_3$) and $C_6$ ($P_3$ to $P_4$). The arc $C_1$ is the same arc as the arc $C_1$ of the first embodiment, and the arc $C_2$ is the same arc as the arc $C_2$ of the first embodiment. A starting end of the parabola $C_5$ is connected to a terminating end of the arc $C_2$, a starting end of the parabola $C_6$ is connected to a terminating end of the parabola $C_5$, and a terminating end of the parabola $C_6$ is connected to the intersection $P_4$. An intersection D and an intersection $P_4$ are located in the same positions as the intersection D and the intersection $P_4$ of the first embodiment.

The female rotor side blowhole contour $R_4$ of the present embodiment is formed by replacing the arcs $C_3$, and $C_4$ of the first embodiment with the parabolas $C_5$, and $C_6$. Similar to the first embodiment, at a connection point of each arc and each parabola, tangents of arcs on both sides across the connection point have the same gradient, and the both tangents are overlapped. In this way, by configuring the female rotor side contour R4 with the two arcs $C_1$ ($P_s$ to $P_1$) and $C_2$ ($P_1$ to $P_2$), and two parabolas $C_5$ ($P_2$ to $P_3$) and $C_6$ ($P_3$ to $P_4$), an area of the compression side blowhole $B_2$ may be reduced. Since, at the connection points of the arc $C_1$ and $C_2$ and parabolas $C_5$ and $C_6$, the tangents of the arcs on both sides across the connection points have the same gradients, different curves may be smoothly connected.

Embodiment 3

Next, a third embodiment of the present invention is described with reference to FIG. 5. The present embodiment is also an example that is applied to a screw rotor equipped on a screw compressor of the same specifications as the first embodiment. In FIG. 5, a female rotor side blowhole hole contour $R_5$ of the present embodiment is composed of two arcs $C_1$ ($P_s$ to $P_1$) and $C_2$ ($P_1$ to $P_2$) and one cubic curve $C_7$ ($P_2$ to $P_4$). The arc $C_1$ is the same arc as the arc $C_1$ of the first embodiment, and the arc $C_2$ is the same arc as the arc $C_2$ of the first embodiment. A starting end of the cubic curve $C_7$ is connected to a terminating end of the arc $C_2$, and a terminating end of the cubic curve $C_7$ is connected to the intersection $P_4$ with the lower cusp line $k_2$.

The female rotor side blowhole contour $R_5$ of the present embodiment is formed by replacing the arcs $C_3$ and $C_4$ of the first embodiment with the cubic curve $C_7$. Similar to the first embodiment, at a connection point of each arc and each parabola, tangents of arcs on both sides across the connection point have the same gradient, and both tangents are overlapped. The other configurations are the same as the first embodiment. It is apparent from FIG. 5 that, according to the present embodiment also, an area of the compression side blowhole $B_2$ may be reduced, and since, at connection points of the arcs $C_1$ and $C_2$ and the cubic curve $C_7$, tangents of the arcs on both sides of the connection points have the same gradients, different curves may be smoothly connected.

EXAMPLE

Next, results obtained by actually designing screw rotors according to the specifications of the first to third embodiments, and measuring lengths of the meshing seal lines s and areas of the compression side blowholes $B_2$ of the designed screw rotors are explained. Table 1 of FIG. 6 illustrates specifications of designed screw rotors. Table 2 of FIG. 7 illustrates lengths of meshing seal lines and blowhole areas of screw rotors produced according to the specifications of Table 1. "A conventional type (conventional technology)" in Table 2 represents the screw rotor proposed in Patent Document 1. From Table 2, it is understood that screw rotors of the present invention is capable of further shortening the meshing seal line length than the conventional type and reducing the blowhole area by about 25% than the conventional type.

INDUSTRIAL APPLICABILITY

According to the present invention, in a screw rotor that is applied to a rotary machine such as a screw compressor, a meshing seal line length and a blowhole area may be reduced than those in the prior art, and thus an internal leakage may be suppressed and performance may be further improved.

The invention claimed is:

1. A screw fluid machine comprising:

a casing having a bore that defines two cusp lines; and two screw rotors disposed in the bore and including a male rotor and a female rotor that are engaged with each other and configured to mutually rotate, wherein, a compression side blow hole is formed between a blowhole side closest point of a meshing seal line formed between the male rotor and the female rotor, and one of the two cusp lines which is positioned at a side where the male rotor and the female rotor start meshing with each other, wherein a female rotor side blowhole contour formed by a line of intersection between a tooth face of the female rotor and a blowhole plane including the blowhole side closest point and said one of the two cusp lines positioned at the side where the female rotor and the male rotor start meshing with each other, is composed of a plurality of contour elements, and wherein the plurality of contour elements include at least two arcs.

2. A screw fluid machine according to claim 1, wherein the two arcs are composed of a first arc whose starting end is the blowhole side closest point of the meshing seal line and a second arc connected to a terminating end of the first arc, and the plurality of contour elements forming the female rotor side blowhole contour includes a contour element composed of a curve extending between a terminating end of the second arc and the said one of the two cusp lines.

3. A screw fluid machine according to claim 2, wherein the curve comprises a third arc connected to the terminating end of the second arc and a fourth arc extending between a terminating end of the third arc and the said one of the two cusp lines.

4. A screw fluid machine according to claim 2, wherein the curve comprises a first parabola connected to the terminating end of the second arc and a second parabola extending between a terminating end of the first parabola and the said one of the two CUSP lines.

5. A screw fluid machine according to claim 2, wherein the curve is composed of one cubic curve.

6. A screw fluid machine according to claim 1, wherein, at a connection point between the plurality of contour elements, tangents of the plurality of contour elements on both sides across the connection point have a same gradient.

* * * * *